US006823848B2

(12) United States Patent
Duplat et al.

(10) Patent No.: US 6,823,848 B2
(45) Date of Patent: Nov. 30, 2004

(54) FUEL INJECTION SYSTEM FOR AN INTERNAL COMBUSTION ENGINE

(75) Inventors: Gérard Duplat, Vaugneray (FR); Raphael Pourret, Lyons (FR); Peter Voigt, Lyons (FR)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/311,859

(22) PCT Filed: Apr. 11, 2002

(86) PCT No.: PCT/DE02/01354

§ 371 (c)(1),
(2), (4) Date: Aug. 27, 2003

(87) PCT Pub. No.: WO02/086307

PCT Pub. Date: Oct. 31, 2002

(65) Prior Publication Data

US 2004/0045529 A1 Mar. 11, 2004

(30) Foreign Application Priority Data

Apr. 21, 2001 (DE) ..... 101 19 602

(51) Int. Cl.[7] ..... F02M 37/04
(52) U.S. Cl. ..... 123/467; 239/88; 239/96
(58) Field of Search ..... 123/467, 496; 239/88–96

(56) References Cited

U.S. PATENT DOCUMENTS 4,750,462 A * 6/1988 Egler et al. ..... 123/467
6,575,140 B2 * 6/2003 Boecking ..... 123/467
2004/0099250 A1 * 5/2004 Strahberger et al. ..... 123/467

FOREIGN PATENT DOCUMENTS

| | | | |
|---|---|---|---|
| DE | 3041018 | * | 5/1982 |
| EP | 0277939 | * | 8/1988 |
| EP | 0336924 A | * | 10/1989 |
| GB | 634030 | * | 3/1950 |
| WO | 0019089 | * | 4/2000 |

* cited by examiner

*Primary Examiner*—Thomas Moulis
(74) *Attorney, Agent, or Firm*—Ronald E. Greigg

(57) ABSTRACT

A fuel injection system having a high-pressure pump and a fuel injection valve for each cylinder of the engine in which the pump has a work chamber, and the fuel injection valve has a valve member movable in an opening direction counter to the force of a closing spring braced between the injection valve member and a displaceable storage piston that is acted upon, on its side remote from the closing spring, by the pressure in the pump work chamber. The storage piston is movable into a storage chamber counter to the force of the closing spring and the deflection stroke motion of the storage piston is limited by a stop. A shaft part having one portion of smaller cross section disposed in an outset position in a connecting bore and one portion of larger cross section disposed outside the connecting bore in the storage chamber, is movable with the storage piston, and upon the deflection stroke motion of the storage piston into the storage chamber, the shaft portion of larger cross section dips into the connecting bore.

19 Claims, 4 Drawing Sheets

FUEL INJECTION SYSTEM FOR AN INTERNAL COMBUSTION ENGINE

CROSS-REFERENCE TO RELATED APPLICATIONS

This application is a 35 USC 371 application of PCT/DE02/01354 filed on Apr. 11, 2002.

BACKGROUND OF THE INVENTION

1. Field of the Invention

The invention is directed to an improved fuel injection system for an internal combustion engine.

2. Description of the Prior Art

One fuel injection system of the type with which this invention is concerned, known from German Patent Disclosure DE 39 00 763 A1, has a high-pressure fuel pump and a fuel injection valve for each cylinder of the engine. The high-pressure fuel pump has an engine-driven pump piston defining a pump work chamber, and a communication of the pump work chamber with a relief chamber is controlled by an electrically controlled valve. The fuel injection valve has an injection valve member, by which at least one injection opening is controlled, and which is movable in an opening direction, counter to the force of a closing spring disposed in a spring chamber, by the pressure prevailing in a pressure chamber that communicates with the pump work chamber. The closing spring is braced on one end at least indirectly on the injection valve member and on the other at least Indirectly on a storage piston. The storage piston, on its side remote from the closing spring, is subjected to the pressure prevailing in the pump work chamber and is movable in a stroke motion counter to the force of the closing spring. The storage piston is movable from an outset position, at low pressure in the pressure chamber, into the storage chamber, and the deflection stroke motion of the storage piston into the storage chamber is limited by a stop. The storage piston has a shaft part, which is disposed in a connecting bore between the storage chamber and the spring chamber and protrudes into the spring chamber. Upon the deflection stroke motion of the storage piston, fuel is positively displaced by the storage piston from the storage chamber into the spring chamber through a gap that is present between the shaft part and the connecting bore. As a result, damping of the stroke motion of the storage piston is accomplished. The damping of the motion of the storage piston can either be constant over the stroke of the storage piston or such that the damping is strong at the onset of the deflection stroke motion and then decreases. It has been found that the damping attained in this way is insufficient, and thus the storage piston strikes the stop at high speed, causing irritating noises.

SUMMARY OF THE INVENTION

The fuel injection system of the invention has the advantage over the prior art that because of how the shaft part is embodied, with the shaft portion of smaller cross section disposed in the connecting bore in the outset position of the storage piston and the shaft portion of larger cross section dipping into the connecting bore upon the deflection stroke motion, the damping is less of the motion of the storage piston at the onset of the deflection stroke motion and is stronger as the deflection stroke motion increases, so that the storage piston strikes the stop at only slight speed, causing only reduced irritating noise, if any.

Other advantageous features and refinements of the fuel injection system of the invention are disclosed. In one embodiment using a support element of the requisite strength; makes simple adjustment of the position of the shaft part relative to the storage piston possible. Another embodiment makes the adjustment of the position of the shaft part possible by using balls of different diameter, which are available as standardized components in various finely graduated diameters. A further embodiment makes it possible for stronger damping to become effective only after a partial deflection stroke of the storage piston.

BRIEF DESCRIPTION OF THE DRAWINGS

Two exemplary embodiments of the invention are described in detail in the ensuing description, taken with the drawings, in which.

DESCRIPTION OF THE PREFERRED EMBODIMENTS

Figure 1:
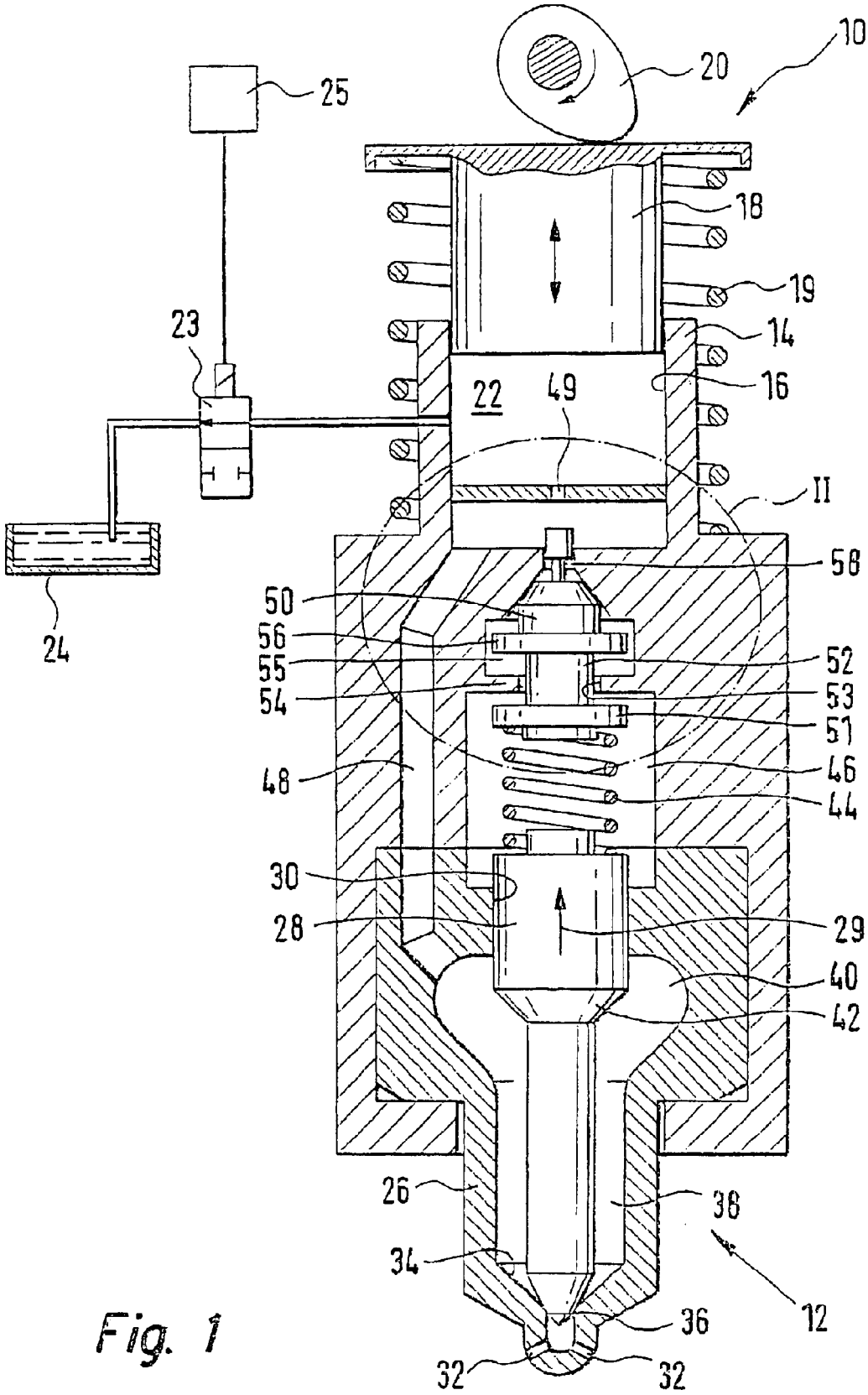
FIG. 1 shows a fuel injection system for an internal combustion engine in a simplified schematic illustration.

In FIGS. 1–5, a fuel injection system for an internal combustion engine of a motor vehicle is shown. The engine has one or more cylinders, and for each cylinder there is one fuel injection system, with a high-pressure fuel pump 10 and a fuel injection valve 12. The high-pressure fuel pump 10 and the fuel injection valve 12 are combined into a so-called unit fuel injector. The high-pressure fuel pump 10 has a pump body 14, in which a pump piston 18 is guided tightly in a cylinder 16; the pump piston is driven in a stroke motion by a cam 20 of a camshaft of the engine, counter to the force of a restoring spring 19. In the cylinder 16, the pump piston 18 defines a pump work chamber 22, in which fuel is compressed at high pressure in the pumping stroke of the pump piston 18. In the intake stroke of the pump piston 18, fuel from a fuel tank 24 is delivered to the pump work chamber, for instance by means of a feed pump. The pump work chamber 22 has a communication with a relief chamber such as the fuel tank 24, and which is controlled by an electrically controlled valve 23. The electrically controlled valve 23 is connected to a control unit 25.

The fuel injection valve 12 has a valve body 26, which can be embodied in multiple parts and is connected to the pump body 14. In the valve body 26, an injection valve member 28 is guided longitudinally displaceably in a bore 30. The bore 30 extends at least approximately parallel to the cylinder 16 of the pump body 14 but can also extend at an incline to it. The valve body 26, in its end region toward the combustion chamber of the cylinder of the engine, has at least one and preferably more injection openings 32. The injection valve member 28, in its end region toward the combustion chamber, has a sealing face 34, which for instance is approximately conical, and which cooperates with a valve seat 36, for instance also approximately conically, embodied in the valve body 26, in its end region toward the combustion chamber, and from the valve seat or downstream of it, the injection openings 32 lead away.

In the valve body 26, between the injection valve member 28 and the bore 30, toward the valve seat 36, there is an annular chamber 38, which in its end region remote from the valve seat 36 changes over, by means of a radial enlargement of the bore 30, into a pressure chamber 40 surrounding the injection valve member 28. At the level of the pressure chamber 40, as a result of a cross-sectional reduction, the injection valve member 28 has a pressure shoulder 42 pointing toward the valve seat 36. The end of the injection valve member 28 remote from the combustion chamber is engaged by a prestressed closing spring 44, by which the injection valve member 28 is pressed toward the valve seat 36. The closing spring 44 is disposed in a spring chamber 46, which adjoins the bore 30. The spring chamber 46 preferably communicates with a relief chamber, such as the fuel tank 24. The pressure chamber 40 communicates with the pump work chamber 22 via a conduit 48 extending through the valve body 26 and the pump body 14.

The closing spring 44 is braced on one end, at least indirectly, for instance via a spring plate, on the injection valve member 28 and on the other end, at least indirectly, for instance also via a spring plate 51, on a storage piston 50. The storage piston 50, in its end region toward the closing spring 44, has a shaft part 52, which passes through a connecting bore 53 in a partition 54 between the spring chamber 46 and a storage chamber 55 adjoining the spring chamber. The spring plate 51 is braced on the end of the shaft part 52 that protrudes into the spring chamber 46. The connecting bore 53 has a smaller diameter than the spring chamber 46 and the storage chamber 55. In the storage chamber 55, the storage piston 50 has one region 56 with a larger diameter than the connecting bore 53, so that a stroke motion of the storage piston 50 into the spring chamber 46 is limited by the fact that the region 56 of the storage piston 50 comes to rest against the partition 54, as a stop. The storage piston 50 is guided with its region 56 tightly in a bore 57 whose diameter is correspondingly larger than the connecting bore 53.

From the storage chamber 55, from its end remote from the spring chamber 46, a bore 58 leads to the pump work chamber 22 through a partition 59. The bore 58 has a smaller diameter than the region 56 of the storage piston 50. Toward the bore 58, adjoining the region 56, the storage piston 50 has a sealing face 60, which is for instance embodied approximately conically. The sealing face 60 cooperates with the orifice of the bore 58 into the storage chamber 55 at the partition 59 as a seat, which can likewise be approximately conical. The storage piston 50 has a shaft 62, which protrudes into the bore 58 and whose diameter is less than that of the region 56. Adjoining the sealing face 60, the shaft 62 initially has a substantially smaller diameter than the bore 58, and adjoining that, toward its free end, it has a shaft region 64 with a diameter that is only slightly smaller than the diameter of the bore 58. The shaft region 64 can have one or more flat faces 65 on its circumference, by which openings 66 between the shaft region 64 and the bore 58 are formed, through which openings fuel from the pump work chamber 22 can reach the storage chamber 55.

Figure 2:
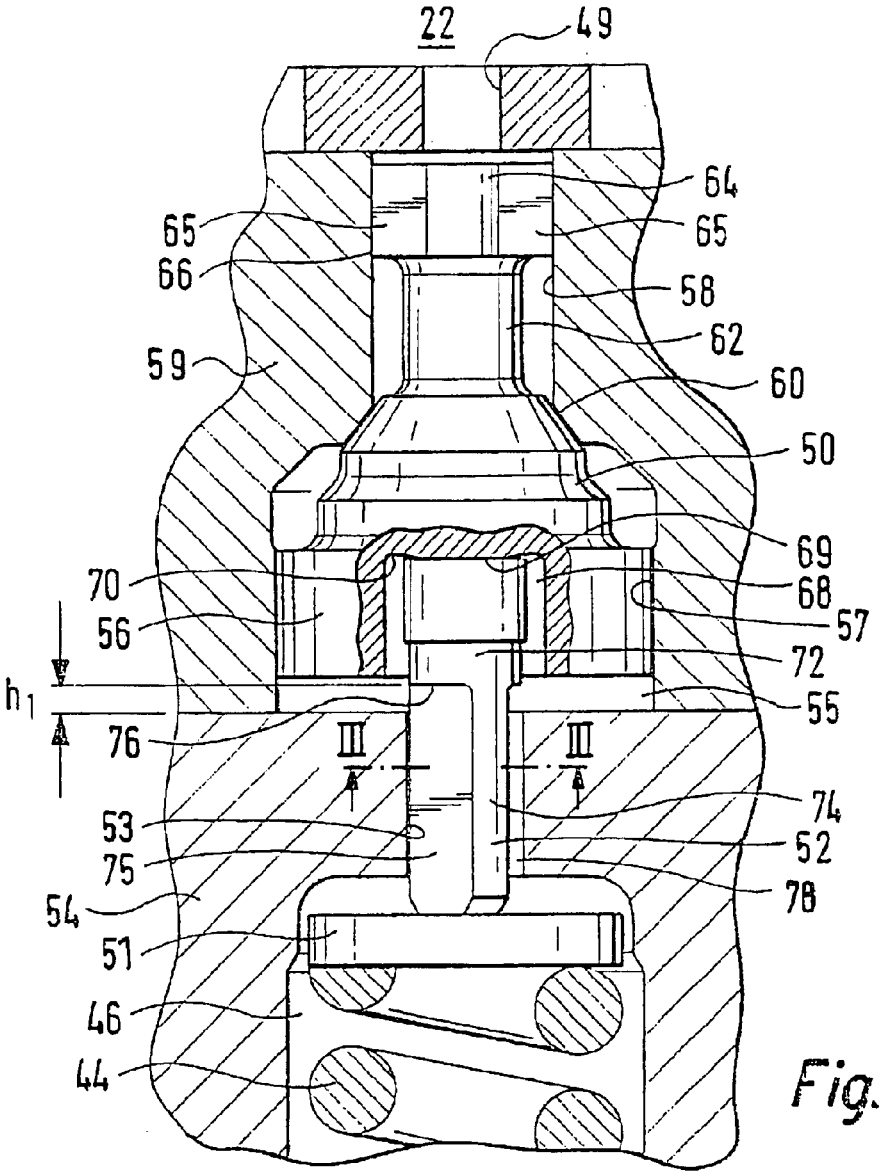
FIG. 2 shows a detail marked II in FIG. 1 on a larger scale, with a storage piston of a first exemplary embodiment, in an outset position.
Figure 3:
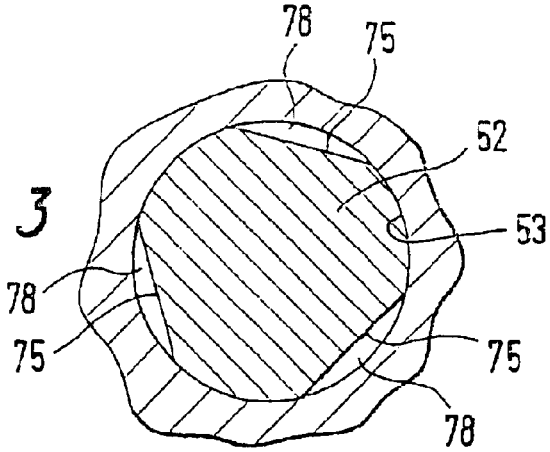
FIG. 3 shows the storage piston in a cross section taken along the line III—III in FIG. 2.

In FIGS. 2 and 3, the storage piston 50 in a first exemplary embodiment is shown, in which the storage piston 50 has an indentation 68 in the face end, toward the partition 54, of its region 56. The indentation 68 has a bottom 69, which can be embodied in raised form by means of a annular groove 70 extending all the way around. With its face end that protrudes into the storage chamber 55, the shaft part 52 rests on the bottom 69 of the indentation 68 of the storage piston 50. The shaft part 52 can also be embodied integrally with the storage piston 50. The contact of the shaft part 52 with the storage piston 50 is assured on the one hand by the force of the closing spring 44 acting on the shaft part 52 and on the other by the force on the storage piston 50 generated by the pressure prevailing in the pump work chamber 22. Because of the raised embodiment of the bottom 69 of the indentation of the storage piston 50, a defined contact face for the shaft part 52 is assured.

The shaft part 52 is divided into a shaft portion 72 of larger cross section, disposed toward the end of the shaft part that protrudes into the storage chamber 55, and a shaft portion 74 of smaller cross section, disposed toward the spring chamber 46. The shaft portion 72 of larger cross section for instance has an at least approximately circular cross section and is embodied circular-cylindrically. The shaft portion 74 of smaller cross section can likewise have an at least approximately circular cross section, but with a smaller diameter than the shaft portion 72, and is embodied circular-cylindrically. Preferably, the smaller cross section of the shaft portion 74 is formed from the shaft portion 72 by means of at least one flat face 75. There may be only one, two, three or more flat faces 75 distributed over the circumference of the shaft portion 74. Between the flat faces 75, the full diameter of the shaft portion 72 is preferably present, so that the shaft portion 74 is likewise guided in the connecting bore 53. In the production of the shaft part 52 with the shaft portions 72, 74, a circular-cylindrical shaft part can be the starting point, which continuously has the diameter of the shaft portion 72, and on which the flat faces 75 are embodied in order to form the shaft portion 74 having the smaller cross section. At the transition to the shaft portion 72, at the jacket of the shaft portion 72, the flat faces 75 end in control edges 76.

If the storage piston 50 is in its outset position, in which it rests with its sealing face 60 on the partition 59 at the orifice of the bore 58, then the storage chamber 55 is disconnected from the pump work chamber 22. In the outset position of the storage piston 50, the shaft portion 74 of the shaft part 52 is disposed in the connecting bore 53, and its shaft portion 72 is disposed in the storage chamber 55, outside the connecting bore 53. The pressure prevailing in the pump work chamber 22 acts on the end face of the shaft region 64 and, through the openings 66, on the sealing face 60 of the storage piston 50 in accordance with the diameter of the bore 58. By the force of the closing spring 44, the storage piston 50 is kept in its outset position, counter to the pressure prevailing in the pump work chamber 22, if the force exerted on the storage piston 50 by the pressure in the pump work chamber 22 is less than the force of the closing spring 44. The storage piston 50 is shown in FIG. 2 in its outset position.

Figure 4:
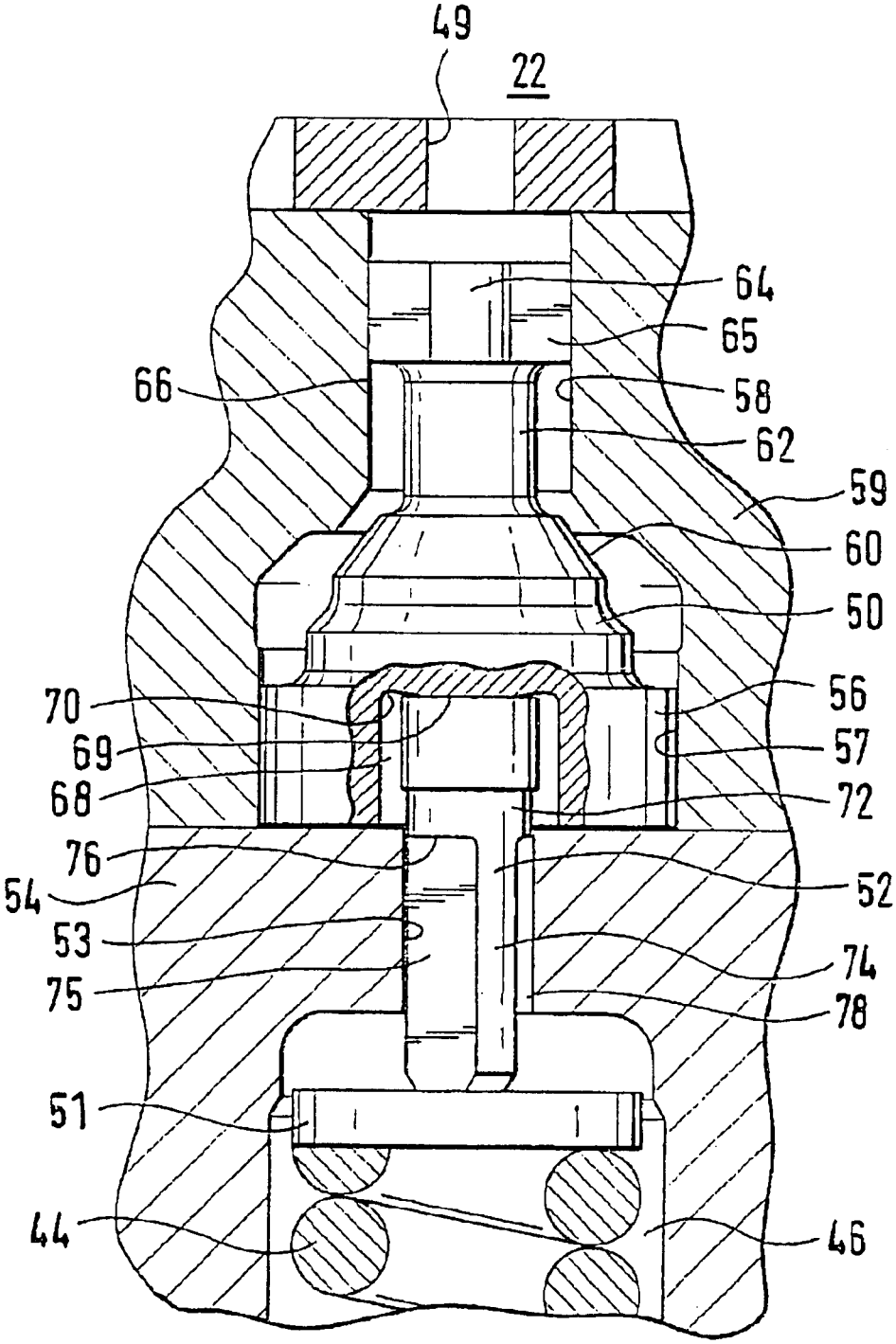
FIG. 4 shows the detail II with the storage piston in a deflected position.

If the pressure in the pump work chamber 22 rises so sharply that the force exerted on the storage piston 50 is greater than the force of the closing spring 44, then the storage piston 50 and with it the shaft part 52 move in a deflecting motion into the storage chamber 55, whereupon the shaft part 52 moves into the spring chamber 46. In the deflection motion of the storage piston 50, fuel is positively displaced out of the storage chamber 55 into the spring chamber 46; this fuel must pass through a gap 78 between the shaft portion 74 of the storage piston 50 and the connecting bore 53. As a result, damping of the deflection motion of the shaft part 52 and thus of the storage piston 50 is attained. Once the storage piston 50, with its sealing face 60, has lifted from the orifice of the bore 58 at the partition 59, the larger-diameter region 56 of the storage piston 50 is acted upon by the pressure prevailing in the pump work chamber 22, reduced by the pressure losses upon throttling through the openings 66, so that a greater force acts on the storage piston 50 counter to the closing spring 44. The shaft portion 74 of the shaft part 52 having the larger cross section is, at the onset of the deflection stroke motion of the storage piston 50, disposed outside the connecting bore 53. After a partial deflection stroke h1 of the storage piston 50, the shaft portion 72 dips into the connecting bore 53; between this shaft portion and the connecting bore 53, only a very small gap 78 now remains. As a result, the deflection stroke motion of the shaft part 52 and thus of the storage piston 50 is strongly damped, so that the storage piston, with its region 56, strikes the partition 54, which forms a stop to limit the deflection stroke motion of the storage piston 50, at only a slight speed. In FIG. 4, the storage piston 50 is shown with its maximum deflection stroke. The length of the partial deflection stroke h1 beyond which the shaft portion 74 dips into the connecting bore 53 and strongly damps the motion of the storage piston 50 is determined by the axial position of the shaft part 52 relative to the storage piston 50. For adjusting this position to achieve a precisely defined partial deflection stroke h1, the length of the shaft part 52 and/or the location of the bottom 69 of the indentation 68 can be varied.

A throttle restriction 49 may be provided in the communication of the pressure chamber 40 with the pump work chamber 22 via the conduit 48. The throttle restriction 49 may also be omitted, in which case the pressure chamber 40 has an unthrottled communication with the pump work chamber 22. The communication of the bore 58, in which the shaft 62 of the storage piston 50 is disposed, is likewise effected via the throttle restriction 49. It can also be provided that the pressure chamber 40 has an unthrottled communication with the pump work chamber 22, and the bore 58 communicates with the pump work chamber 22 via the throttle restriction 49.

The function of the fuel injection system will now be explained. The pump work chamber 22 is filled with fuel during the intake stroke of the pump piston 18. In the pumping stroke of the pump piston 18, the control valve 23 is open at first, and thus high pressure cannot build up in the pump work chamber 22. When the fuel injection is to begin, the control valve 23 is closed by the control unit 25, so that the pump work chamber 22 is disconnected from the fuel tank 24, and high pressure builds up in it. Once the pressure in the pump work chamber 22 and in the pressure chamber 40 is so high that the force acting in the opening direction 29 on the injection valve member 28 via the pressure shoulder is greater than the force of the closing spring 44, the injection valve member 28 moves in the opening direction 29 and uncovers the at least one injection opening 32, through which fuel is injected into the combustion chamber of the cylinder. The storage piston 50 is in its outset position at this time. The pressure in the pump work chamber 22 subsequently increases further, in accordance with the profile of the cam 20.

When the force exerted on the storage piston 50 by the pressure prevailing in the pump work chamber 22 becomes greater than the force exerted on the storage piston 50 by the closing spring 44, the storage piston 50 executes its deflection stroke motion and moves into the storage chamber 55. This causes a pressure drop in the pump work chamber 22 and also increases the prestressing of the closing spring 44, which is braced on the storage piston 50 via the shaft part 52. As a result of the pressure drop in the pump work chamber 22 and in the pressure chamber 40, there is a lesser force on the injection valve member 28 in the opening direction 29, and because of the increase in the prestressing of the closing spring 44 there is an increased force in the closing direction on the injection valve member 28, so that the injection valve member is moved in the closing direction again, comes to rest with its sealing face 34 on the valve seat 36, and closes the injection openings 32, so that the fuel injection is interrupted. The fuel injection valve 12 is opened for only a brief time, and only a slight quantity of fuel is injected as a preinjection into the combustion chamber. The injected fuel quantity is determined essentially by the opening pressure of the storage piston 50, which is the pressure in the pump work chamber 22 at which the storage piston 50 begins its deflection stroke motion. The opening stroke of the injection valve member 28 during the preinjection can be limited hydraulically by a damping device. One such damping device is known from DE 39 00 762 A1 and the corresponding U.S. Pat. No. 5,125,580, as well as DE 39 00 763 A1 and the corresponding U.S. Pat. No. 5,125,581, which are hereby incorporated by reference into the present patent application.

The pressure in the pump work chamber 22 subsequently increases further, in accordance with the profile of the cam 20, so that the pressure force acting on the injection valve member 28 in the opening direction 29 increases again and exceeds the closing force that has been increased because of the increased prestressing of the closing spring 44, and so the fuel injection valve 12 opens again. Now a larger quantity of fuel is injected over a longer period of time than during the preinjection. The duration and the fuel quantity injected during this main injection are determined by the instant at which the control valve 23 is opened again by the control unit 25. After the opening of the control valve 23, the pump work chamber 22 again communicates with the fuel tank 24 and is thus relieved, and the fuel injection valve 12 closes. The storage piston 50 with the shaft part 52 is moved back into its outset position again by the force of the closing spring 44. The chronological offset between the preinjection and the main injection is determined primarily by the deflection stroke of the storage piston 50.

Figure 5:
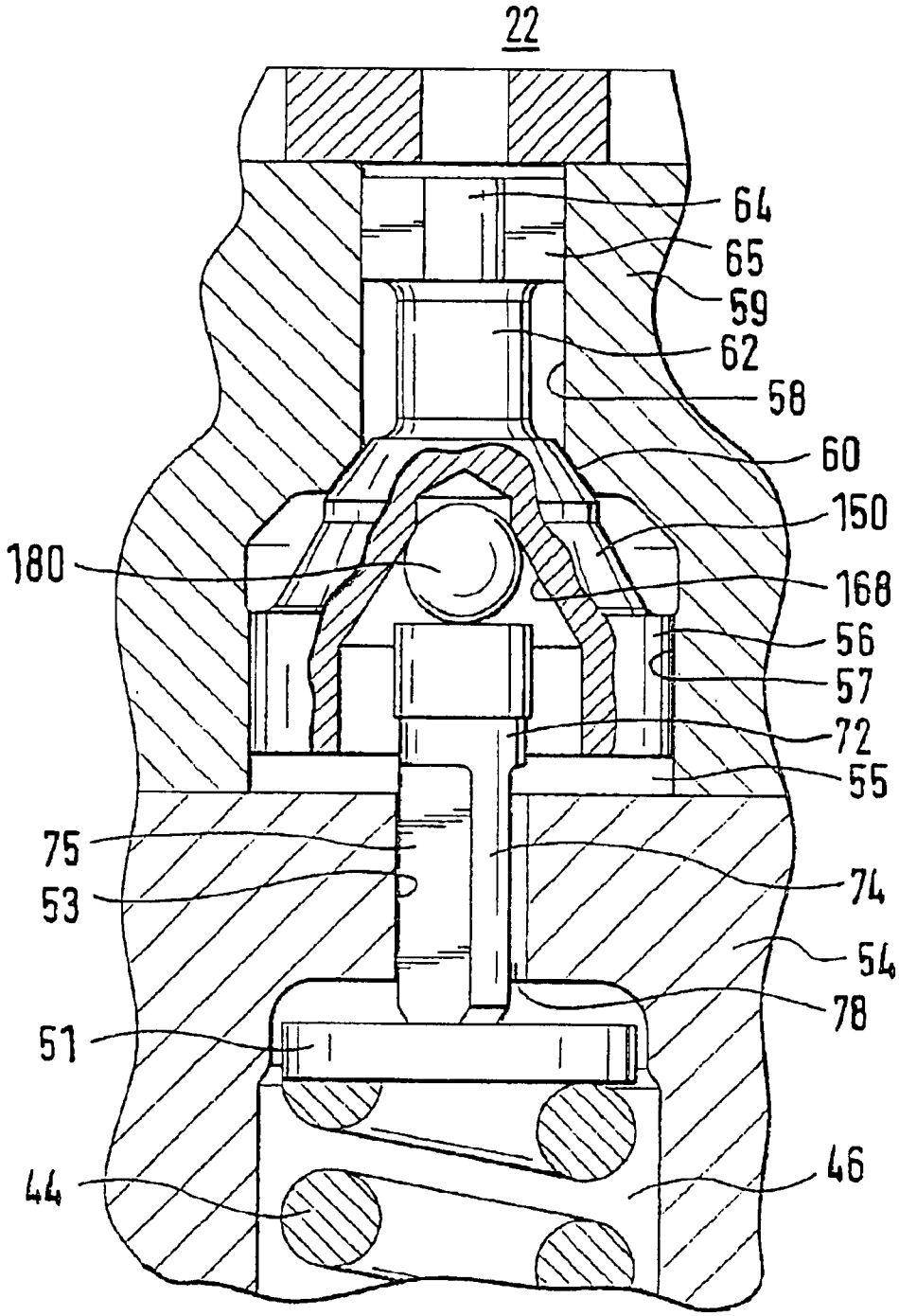
FIG. 5 shows the detail II with the storage piston, in a second exemplary embodiment.

In FIG. 5, the storage piston 150 is shown in a second exemplary embodiment, in which the embodiment of the storage piston is substantially the same as in the first exemplary embodiment, but the indentation 168 in the storage piston 150 is embodied such that it narrows approximately conically in the storage piston. In the indentation 168, there is a support element 180, which is braced in the indentation 168 and on which the shaft part 52, which is unchanged from the first exemplary embodiment, comes to rest. The support element 180 is preferably embodied in the form of a ball, whose diameter d is greater than the smallest diameter of the indentation 168. Depending on the diameter d of the ball 180, this ball dips to a variable extent into the indentation 168, so that the contact point for the shaft part 52 also assumes a variable position. The position of the shaft part 52 relative to the storage piston 50 in the axial direction is essential for the partial deflection stroke h1 of the storage piston 50 beyond which the larger-cross-section shaft portion 72 of the shaft part 52 dips into the connecting bore 53, and thus the deflection stroke motion is strongly damped. The axial position of the shaft part 52 relative to the storage piston 50 can be adjusted precisely in a simple way by using a ball 180 of suitable diameter. Such balls 180 are available as standardized components, with finely graduated diameters. The smaller the diameter of the ball 180, the farther it dips into the indentation 168, and thus the longer the partial stroke h1 until the shaft portion 74 dips into the connecting bore 53.

The foregoing relates to preferred exemplary embodiments of the invention, it being understood that other variants and embodiments thereof are possible within the spirit and scope of the invention, the latter being defined by the appended claims.

What is claimed is:

1. In fuel injection system for an internal combustion engine, having a high-pressure fuel pump (10) and a fuel injection valve (12) for a cylinder of the engine, wherein the high-pressure fuel pump (10) has a pump piston (18), driven by the engine and defining a pump work chamber (22), and having an electrically controlled valve (23) by which a connection of the pump work chamber (22) with a relief chamber (24) is controlled, the fuel injection valve (12) having an injection valve member (28) by which at least one injection opening (32) is controlled, and which is movable in an opening direction (29), counter to the force of a closing spring (44) disposed in a spring chamber (46), by the pressure prevailing in a pressure chamber (40) communicating with the pump work chamber (22), the closing spring (44) being braced on one end at least indirectly on the injection valve member (28) and on the other ending at least indirectly on a displaceable storage piston (50; 150) that is acted upon, on its side remote from the closing spring (44), by the pressure prevailing in the pump work chamber (22), the storage piston (50; 150) being movable, beginning at an outset position, counter to the force of the closing spring (44) into a storage chamber (55), and the deflection stroke motion of the storage piston (50; 150) into the storage chamber (55) is limited by a stop (54), and a shaft part (52) that is movable with the storage piston (50; 150) protrudes into the spring chamber (46) through a connecting bore (53) between the storage chamber (55) and the spring chamber (46), and upon the deflection stroke motion of the storage piston (50; 150), fuel is positively displaced by the storage piston out of the storage chamber (55) into the spring chamber (46), through a gap (78) between the shaft part (52) and the connecting bore (53), into the spring chamber (46) and by this means a damping of the stroke motion of the storage piston (50; 150) is effected, the improvement wherein the shaft part (52) has one shaft portion (74) of smaller cross section, disposed in the connecting bore (53) in the outset position of the storage piston (50; 150), and one shaft portion (72) of larger cross section, disposed wherein outside the connecting bore (53) in the storage chamber (55); and wherein in the deflection stroke motion of the storage piston (50; 150) into the storage chamber (55), the shaft portion (72) of larger cross section dips into the connecting bore (53).

2. The fuel injection system of claim 1, wherein the shaft part (52) is embodied separately from the storage piston (50; 150), and by the force of the closing spring (44), on the one hand, and by the forces generated by the pressure prevailing in the pump work chamber (22), on the other, the shaft part (52) is kept in contact, at least indirectly, with the storage piston (50; 150).

3. The fuel injection system of claim 2, wherein the shaft part (52) rests on the storage piston (150) via a support element (180).

4. The fuel injection system of claim 3, wherein the support element (180) is embodied at least approximately as a ball, which is disposed in an at least approximately conical indentation (168) in a face end, toward the shaft part (52), of the storage piston (150).

5. The fuel injection system of claim 1, wherein the shaft portion (72) of larger cross section does not dip into the connecting bore (53) until after a partial deflection stroke (h1) of the storage piston (50; 150).

6. The fuel injection system of claim 2, wherein the shaft portion (72) of larger cross section does not dip into the connecting bore (53) until after a partial deflection stroke (h1) of the storage piston (50; 150).

7. The fuel injection system of claim 3, wherein the shaft portion (72) of larger cross section does not dip into the connecting bore (53) until after a partial deflection stroke (h1) of the storage piston (50; 150).

8. The fuel injection system of claim 4, wherein the shaft portion (72) of larger cross section does not dip into the connecting bore (53) until after a partial deflection stroke (h1) of the storage piston (50; 150).

9. The fuel injection system of claim 5, wherein the transition from the shaft portion (72) of larger cross section of the shaft part (52) and the shaft portion (74) of smaller cross section takes place in a control edge (76) that ends at the jacket of the shaft part (52).

10. The fuel injection system of claim 6, wherein the transition from the shaft portion (72) of larger cross section of the shaft part (52) and the shaft portion (74) of smaller cross section takes place in a control edge (76) that ends at the jacket of the shaft part (52).

11. The fuel injection system of claim 7, wherein the transition from the shaft portion (72) of larger cross section of the shaft part (52) and the shaft portion (74) of smaller cross section takes place in a control edge (76) that ends at the jacket of the shaft part (52).

12. The fuel injection system of claim 8, wherein the transition from the shaft portion (72) of larger cross section of the shaft part (52) and the shaft portion (74) of smaller cross section takes place in a control edge (76) that ends at the jacket of the shaft part (52).

13. The fuel injection system of claim 1, wherein the shaft portion (74) of smaller cross section of the shaft part (52) is formed, beginning at the shaft portion (72) of larger cross section, by at least one flat face (75) on the circumference of the shaft part (52).

14. The fuel injection system of claim 2, wherein the shaft portion (74) of smaller cross section of the shaft part (52) is formed, beginning at the shaft portion (72) of larger cross section, by at least one flat face (75) on the circumference of the shaft part (52).

15. The fuel injection system of claim 3, wherein the shaft portion (74) of smaller cross section of the shaft part (52) is formed, beginning at the shaft portion (72) of larger cross section, by at least one flat face (75) on the circumference of the shaft part (52).

16. The fuel injection system of claim 4, wherein the shaft portion (74) of smaller cross section of the shaft part (52) is formed, beginning at the shaft portion (72) of larger cross section, by at least one flat face (75) on the circumference of the shaft part (52).

17. The fuel injection system of claim 5, wherein the shaft portion (74) of smaller cross section of the shaft part (52) is formed, beginning at the shaft portion (72) of larger cross section, by at least one flat face (75) on the circumference of the shaft part (52).

18. The fuel injection system of claim 9, wherein the shaft portion (74) of smaller cross section of the shaft part (52) is formed, beginning at the shaft portion (72) of larger cross section, by at least one flat face (75) on the circumference of the shaft part (52).

19. The fuel injection system of claim 13, wherein the shaft portion (72) of larger cross section of the shaft part (52) is embodied as at least approximately circular-cylindrical.

* * * * *